US010631597B2

(12) United States Patent
Betz et al.

(10) Patent No.: US 10,631,597 B2
(45) Date of Patent: Apr. 28, 2020

(54) SEAT BELT BUCKLE

(71) Applicant: TRW AUTOMOTIVE GMBH, Alfdorf (DE)

(72) Inventors: Hans-Peter Betz, Böbingen (DE); Peter Haas, Eschach (DE); Jörg Meyer, Alfdorf-Adelstetten (DE); Ralf Knoedl, Alfdorf (DE)

(73) Assignee: TRW AUTOMOTIVE GMBH, Alfdorf (DE)

( * ) Notice: Subject to any disclaimer, the term of this patent is extended or adjusted under 35 U.S.C. 154(b) by 401 days.

(21) Appl. No.: 15/322,744

(22) PCT Filed: Jul. 15, 2015

(86) PCT No.: PCT/EP2015/001451
§ 371 (c)(1),
(2) Date: Dec. 29, 2016

(87) PCT Pub. No.: WO2016/008585
PCT Pub. Date: Jan. 21, 2016

(65) Prior Publication Data

US 2017/0127765 A1 May 11, 2017

(30) Foreign Application Priority Data

Jul. 15, 2014 (DE) ..... 10 2014 010 403
Nov. 10, 2014 (DE) ..... 10 2014 016 520

(51) Int. Cl.
*A44B 11/25* (2006.01)
*F21V 23/00* (2015.01)
*F21V 3/04* (2018.01)
*F21V 7/00* (2006.01)
*F21V 3/06* (2018.01)

(52) U.S. Cl.
CPC ..... *A44B 11/2565* (2013.01); *A44B 11/2561* (2013.01); *F21V 3/0625* (2018.02); *F21V 7/0091* (2013.01); *F21V 23/009* (2013.01)

(58) Field of Classification Search
CPC ..... A44B 11/2565; A44B 11/2561; F21V 3/0625; F21V 23/009; F21V 7/0091
See application file for complete search history.

(56) References Cited

U.S. PATENT DOCUMENTS 3,568,268 A 3/1971 Cunningham
4,237,586 A 12/1980 Morinaga
5,176,439 A 1/1993 Kawamura
5,892,436 A * 4/1999 Blackburn ..... A44B 11/2565 180/268

(Continued)

FOREIGN PATENT DOCUMENTS

DE 202004007872 9/2004

*Primary Examiner* — Robert Sandy
*Assistant Examiner* — Louis A Mercado
(74) *Attorney, Agent, or Firm* — Tarolli, Sundheim, Covell & Tummino LLP

(57) ABSTRACT

A belt buckle includes a casing (12) and an illumination system (24) present in the area of a locking tongue insertion opening (14). The illumination system (24) includes a lamp (32) and a light conductor (26; 26') having a light emission area, and the light conductor (26; 26') includes an annular portion (42; 42') which surrounds at least a major part of the locking tongue insertion opening (14).

17 Claims, 9 Drawing Sheets

(56) References Cited

U.S. PATENT DOCUMENTS

| | | | | |
|---|---|---|---|---|
| 9,907,366 | B2 * | 3/2018 | Krauss | A44B 11/2546 |
| 2006/0285344 | A1 | 12/2006 | Kohama et al. | |
| 2007/0236917 | A1 | 10/2007 | Gray et al. | |
| 2012/0089302 | A1 | 4/2012 | Griffin | |
| 2016/0167574 | A1 * | 6/2016 | McClelland | B60R 22/18<br>362/546 |

* cited by examiner

Fig. 7
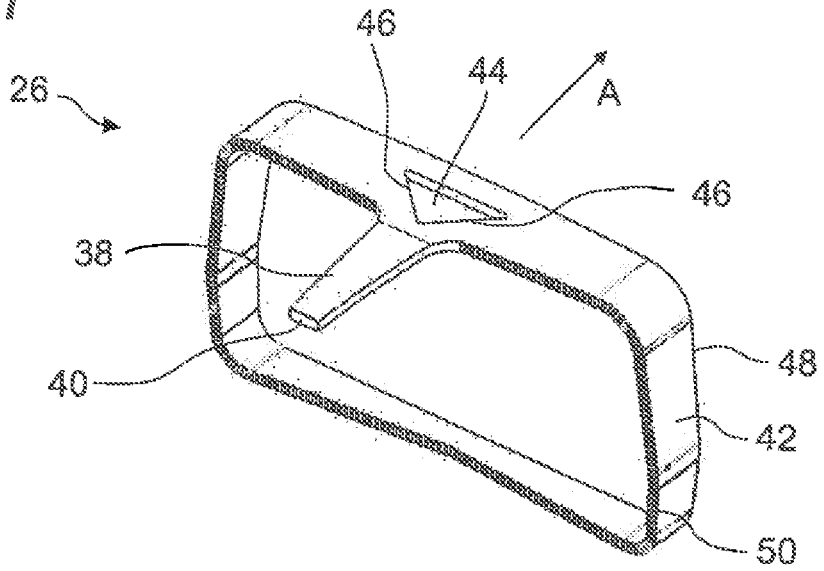
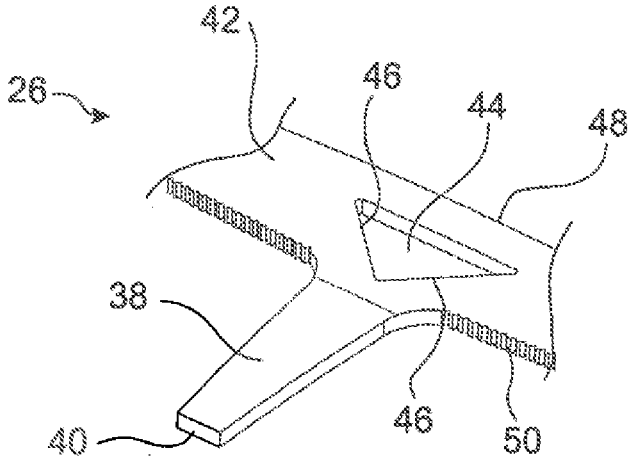
Fig. 8
Fig. 9
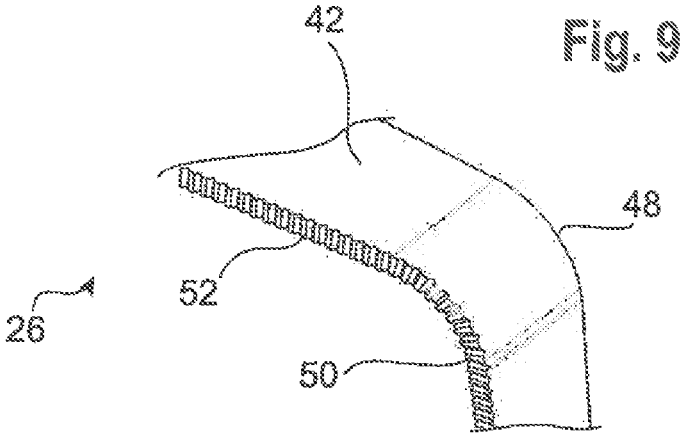

SEAT BELT BUCKLE

RELATED APPLICATIONS

This application corresponds to PCT/EP2015/001451, filed Jul. 15, 2015, which claims the benefit of German Application No. 10 2014 010 403.6, filed Jul. 15, 2014 and German Application No. 10 2014 016 520.5, filed Nov. 10, 2014, the subject matter of which are incorporated herein by reference in their entirety.

BACKGROUND OF THE INVENTION

The invention relates to a belt buckle of a seat belt.

A belt buckle is part of a safety means in a vehicle and is tightly connected to the body of the vehicle. A locking tongue at which webbing is provided which partly surrounds a vehicle occupant when the locking tongue is inserted so as to fix said occupant on the vehicle seat in the case of strong deceleration of the vehicle may be inserted into the belt buckle.

Belt buckles including illumination systems are generally known from prior art, the illumination serving for marking a receiving area for the locking tongue so that the vehicle occupant is able to find the belt buckle more quickly. Quickly finding the belt buckle increases the buckling rate, as the vehicle occupant need not search for the belt buckle which might reduce the motivation to buckle up. The illumination devices are intended to safeguard reliable and permanent illumination of the receiving area.

The belt buckles known from prior art usually include a belt buckle casing which typically has been manufactured by a welding method adhesively connecting two casing halves. Due to said adhesive connection, the illumination system can be replaced with considerably effort only, which is perceived as a drawback. Moreover, the constructed space inside the belt buckle is restricted; therefore a very compact design of the illumination system is required. In addition, the receiving area is to be illuminated extensively and with high light intensity so that the vehicle occupant is able to find the receiving area even in the case of inconvenient positions of the belt buckle. Previous belt buckles have not met these requirements to the complete satisfaction.

SUMMARY OF THE INVENTION

It is the object of the invention to provide a belt buckle which enables most appropriate and permanent illumination of the receiving area of the locking tongue with minimum space required and provides an illuminated locking tongue insertion opening. It is a further object of the invention to provide a belt buckle that is easy and inexpensive to manufacture and moreover allows for individual customization of the belt buckle to various vehicle types, for example.

In accordance with the invention, this object is achieved by a belt buckle comprising a casing and an illumination system present in the area of a locking tongue insertion opening, with the illumination system comprising a lamp and a light conductor having a light emission area and the light conductor including an annular portion which surrounds at least a major part of the locking tongue insertion opening. Providing an annular portion at the light conductor permits illuminating the locking tongue insertion opening specifically at any positions along its periphery and preferably over its entire periphery so as to produce an unambiguous high-quality marking of the locking tongue insertion opening. The illumination is carried out in an area which, on the one hand, is clearly discernible by the vehicle occupant during insertion of the locking tongue and which, on the other hand, is positioned so that it is possible to use of any design elements in the area of the body of the casing.

The casing, hereinafter also referred to as belt buckle casing, may have a circumferential edge, for example, which borders a receiving area for a locking tongue as well as an illumination system which includes a light conductor and a lamp, wherein the light conductor has a light emission area in the form of an output surface provided at the edge of the belt buckle casing and forming the light emission area. The edge of the belt buckle casing represents the portion of the belt buckle casing which is located directly in the visual range of the vehicle occupant when the belt buckle adopts its typical position inside the vehicle. Since the output surface of the light conductor is provided at said edge, the receiving area forming the locking tongue insertion opening is ensured to be illuminated so perfectly that the vehicle occupant may find the same even in the case of inconvenient positions of the belt buckle. Via the light conductor the light emitted by the lamp is guided to the output surface, which enables compact arrangement of the illumination system. This is due to the fact that the lamp itself may be arranged at a position inside the belt buckle where more space is available than directly at the edge. The lamp may especially be a LED which has a particularly compact design.

Preferably the light emission area is formed to be peripherally circumferential on an axial end face of the annular portion of the light conductor, thus enabling illumination extending circumferentially around the locking tongue insertion opening. The light emission area may widthwise be, for example, about 1 mm in the radial direction (radially relative to the inserting direction), resulting in an unobtrusive but still clearly discernible illumination in the area of the locking tongue insertion opening without increasing the volume of the belt buckle.

The light conductor preferably is made from transparent plastic material, especially from polycarbonate (PC).

In order to obtain uniform illumination the light conductor may have a structured surface on an outer surface facing away from the light emission area. Said structured surface is designed so that it is not planar but has a plurality of juxtaposed small structures which are configured and oriented so that they reflect light back into the interior of the annular area of the light conductor and in this way produce homogenous distribution of the light inside the light conductor. Preferably the structured surface is provided on an end face of the annular portion of the light conductor opposite to the light emission area.

The structured surface includes, for example, a plurality of juxtaposed prisms each having especially a trapezoidal or triangular cross-section and forming sort of a saw-tooth structure along the rear end face of the light conductor. In this way, also with punctual coupling of the light into the light conductor very uniform illumination of the entire annular portion can be obtained.

For coupling the light from the lamp into the light conductor the latter may have an extension axially projecting from the annular portion of the light conductor or a coupling element. The extension preferably extends up to an area in which the lamp of the illumination system can be easily placed and guides the light from the lamp to the annular portion and to the light emission area.

In order to further improve the distribution of the light in the annular portion of the light conductor a recess may be provided in the annular portion for example in the area of the transition of the extension into the annular portion within the light conductor. Said recess is shaped so that the coupled light is distributed uniformly in the annular portion. The coupled light is reflected especially at edges of the recess inclined relative to the axial direction into the annular portion in the circumferential direction and thus is distributed uniformly within the annular portion. For instance, the recess is a breakthrough in the annular portion taking an approximately triangular shape with the point being directed toward the extension. Instead of a triangular shape, also different shapes can be used which suitably have reflective surfaces being inclined relative to the axial direction and thus being adapted to produce reflection into the annular portion.

In a preferred embodiment, the annular portion of the light conductor is arranged radially inside an at least largely peripherally closed front panel of the casing which is considered to be a further casing part, with the front panel framing the insertion opening. The front panel shields the light conductor radially outwardly, wherein it may extend over the entire axial length of the light conductor and beyond the same. The outer surface of the front panel may have any design and may be used as a customized design element.

An even more uniform light distribution along the light emission area as well as the option of individually designing the light emission area of the belt buckle for different types of vehicles can be achieved by the front panel including an annular, at least partially transparent diffusor which with its front side is axially adjacent to the light emission area of the light conductor. Said diffusor moreover is adapted to shade portions of the light emission area or is adapted to vary the coloring of the emitted light.

For reducing total reflections and for reasons of high light emission through the diffusor an air gap is arranged between the diffusor and the light conductor. The height of the air gap between the diffusor and the light conductor amounts to less than 0.5 mm and is preferably within the range of from 0.15 mm to 0.35 mm.

The outside of the diffusor facing away from the light conductor exhibits a very finely grained structure by which the homogeneity of the light emission is even further improved. For this purpose, the diffusor is roughened with a minimum fineness of grind.

Except for the diffusor, the front panel is preferably opaque so that light emits through the diffusor only.

The front panel and the diffusor can be manufactured in one piece by two-component injection-molding, for example from acrylonitrile-butadiene-styrene (ABS) and polycarbonate (PC).

The front panel and the light conductor preferably are separate components, however, with a fabrication in one piece being imaginable as well. The front panel may be attached to the light conductor when manufacturing the belt buckle and the light conductor and the front panel may be welded to each other for final mounting, for example by ultrasound or laser welding.

The casing of the belt buckle preferably includes a first shell part including an annularly circumferential projection which is arranged radially inside the light conductor. Said circumferential projection is arranged on an end of the first shell part on the side of the insertion opening, and the annular portion of the light conductor is configured so that it can be attached to the projection of the first shell part. The annularly circumferential projection of the first shell part shields the light conductor radially inwardly toward the locking tongue insertion opening so that no undesired light is emitted there.

The light conductor may be welded to the annularly circumferential projection of the first shell part or may be fastened thereto in any other suitable manner.

The illumination system preferably comprises an electronic control module in which the lamp as well as electronics is arranged. Especially the electronic control module is mounted on the inside of the first shell part of the casing. The lamps used are e.g. one or more LED. In this way, an option for changing the color of the lamp can be easily provided. The choice of color may be stored in a memory of the electronic control module and may thus be adapted to different types of vehicles.

The electric feed line may be integrated in an electric feed line of a seat occupancy detection switch in the belt buckle so as to reduce the number of separate electric cables. Excessive load of the feed line can be prevented by strain relief at the first shell part of the casing.

It is possible to pre-assemble the electronic control module on the first shell part, thus reducing the number of individual components of the belt buckle in the final assembly. As a matter of course, the electronic control module may also be placed at a different casing part.

The electric control module preferably is a LIN module (Local Interconnect Network Bus) and is connectable to general vehicle electronics.

In a preferred embodiment, the casing of the belt buckle merely consists of the first shell part, the front panel and a second shell part so that quick and uncomplicated assembly of the belt buckle is possible.

According to one aspect, the light conductor is connected to, especially engaged in or permanently mounted to the belt buckle casing. This allows for an especially compact design of the belt buckle casing, as the light conductor need not be fastened to the belt buckle casing by means of fasteners. In addition, this facilitates manufacture of the belt buckle. An engaging connection further allows for replacement of the light conductor. The light conductor may be injection-molded with the pertaining casing part especially by two-component injection-molding so that no assembly is required. Accordingly, the light conductor may be injection-molded to the belt buckle casing.

Furthermore, the output surface may be circumferential. The output surface provided on the edge hence may enclose the insertion opening forming the receiving area in ring shape so that the vehicle occupant can quickly discern where the receiving area is located, i.e. in the area enclosed by the output surface. In this way the buckling rate is increased, because the vehicle occupant need not search very hard for the receiving area.

Another aspect provides the light conductor to include a coupling element which is coupled to the lamp and is especially tapered in wedge shape. It is ensured by the coupling element of the light conductor that the light emitted by the lamp is coupled completely into the light conductor. In this way, the light intensity is increased in the area of the output surface. Due to the wedge shape of the coupling element, nevertheless a space-saving light conductor is provided which has an appropriately large cross-section in the coupling area only.

In particular, the belt buckle casing is composed of several shell parts, with the light conductor being associated with a casing portion on which the edge is formed. The multi-part design of the belt buckle casing enables the belt buckle casing to be quickly and easily opened, which allows for quick and easy replacement of the illumination system. Further it is safeguarded that the output surface is provided on the edge of the belt buckle casing, as the light conductor is arranged on the casing portion of the multi-part belt buckle casing.

Another aspect provides that the light conductor is substantially embedded in the casing portion. This means that the light conductor is substantially surrounded by casing material so that no additional light output surfaces are formed, as this would be the case if the light conductor were arranged only on the inside of the bell buckle casing. Accordingly, the light conductor is substantially completely enclosed by the casing portion. Merely the output area and the coupling area are not enclosed by the casing material of the casing portion in which the light conductor is embedded.

Especially the belt buckle casing may be designed in two parts and may comprise two shell parts or casing shells, the casing portion being provided on a first casing shell. The two-part design allows quick and easy opening of the belt buckle casing as well as easy manufacture, as a first casing shell includes the substantial parts of the belt buckle, for example the illumination system, whereas the second casing shell merely serves for closing the belt buckle casing. Hence the second casing shell constitutes a kind of cover element. The second casing shell may be a standardized casing shell.

Alternatively, the belt buckle casing may be a three-part design and may comprise two shell parts as well as one, especially insertable, casing member corresponding to the afore-described front panel on which the casing portion is provided. The two shell parts may be conventional standardized belt buckle shells which can be coupled to each other so as to form sort of a base body of the casing buckle. The casing part which is adapted to be inserted into the base body includes the casing portion on which the light conductor is provided. The casing part therefore is ring-shaped and provides the edge of the belt buckle casing bordering the receiving area for the locking tongue.

Especially the light conductor may have a connecting structure by which the casing part forming the front panel is connectable to the other shell parts. The casing part is tightly coupled to the two shell parts via the light conductor so that a complete belt buckle casing is provided.

An afore-described belt buckle can be manufactured so that the light conductor and at least one casing portion are simultaneously injection-molded, especially by multi-component injection-molding. This enables especially quick and easy manufacture of the belt buckle, as the belt buckle casing is formed at least partially directly with the light conductor. Therefore the light conductor need not be coupled subsequently to the belt buckle casing. Furthermore it is ensured in this way that the orientation of the light conductor inside the belt buckle casing is correct, which guarantees homogenous illumination of the output surface. The other parts of the belt buckle may be configured as a simple and inexpensive injection-molded part which includes merely one material component.

Especially the light conductor and the at least one casing portion are injection-molded such that the light conductor is embedded substantially in the casing portion. In this way the light conductor is protected, on the one hand, by the casing material surrounding the same and, on the other hand, it is safeguarded that the light conductor merely has the output surface provided at the edge. Accordingly, the light intensity at the output surface is appropriately high, as no scattering loss or the like will occur.

BRIEF DESCRIPTION OF THE DRAWINGS

Hereinafter the invention shall be described in detail by way of an embodiment and with reference to the enclosed drawings, wherein:

FIG. 7 shows a perspective representation of a light conductor of the belt buckle according to the invention from FIG. 1;

FIGS. 8 and 9 show details of the light conductor from FIG. 7;

DESCRIPTION

Figure 1:
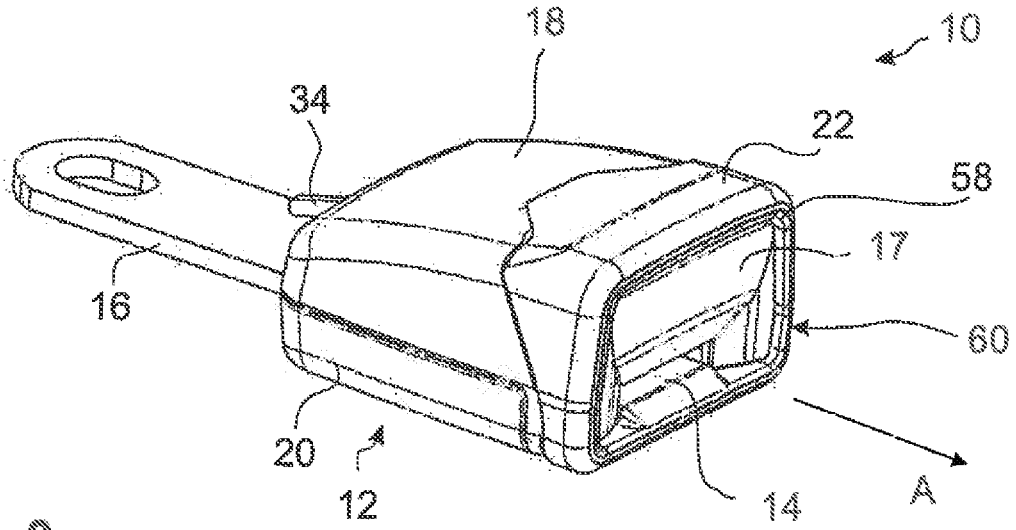
FIG. 1 shows a schematic perspective representation of a belt buckle according to the invention.
Figure 2:
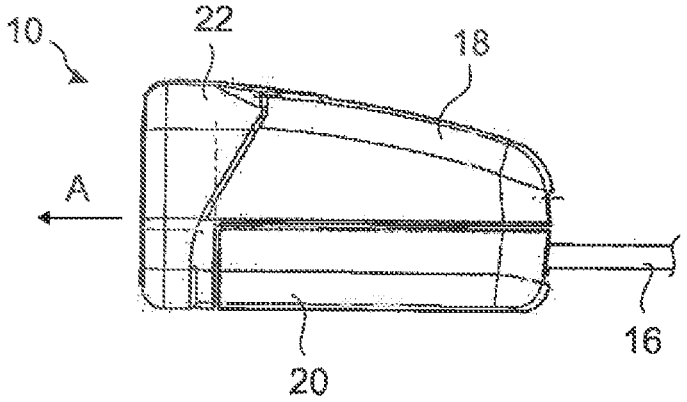
FIG. 2 shows the belt buckle from FIG. 1 in a side view.
Figure 3:
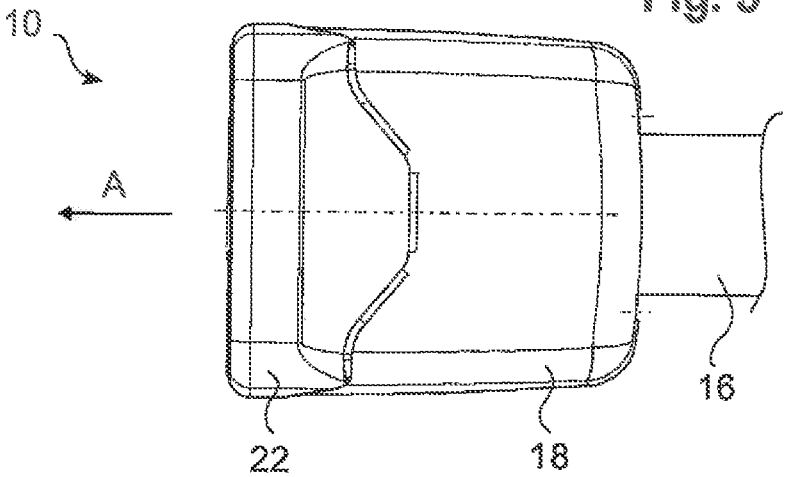
FIG. 3 shows the belt buckle from FIG. 1 in a top view.

FIG. 1 illustrates a belt buckle 10 comprising a casing 12 in which a locking tongue insertion opening 14 for a locking tongue of a seat belt system not shown in detail is provided in a vehicle. The casing 12 encloses a support 16 on which an internal mechanism for fixing the locking tongue including a button 17 for releasing the locking tongue is mounted (also see FIG. 14). The support 16 includes a portion extending out of the casing 12 in the axial direction A and serving for fastening the belt buckle 10 on the vehicle.

Figure 4:
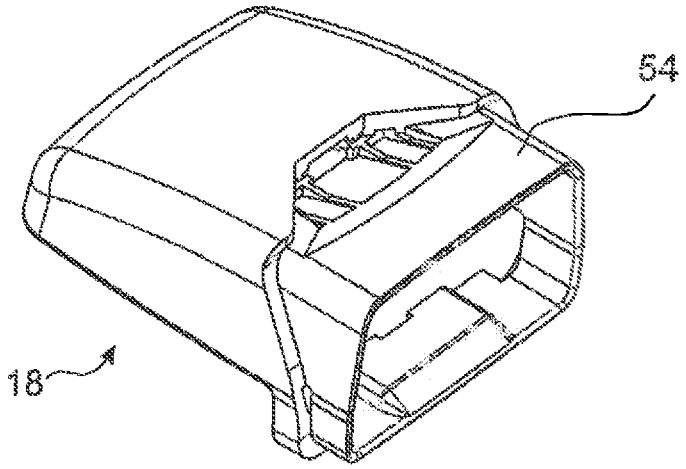
FIG. 4 shows a first shell part of the casing of the belt buckle from FIG. 1.
Figure 11:
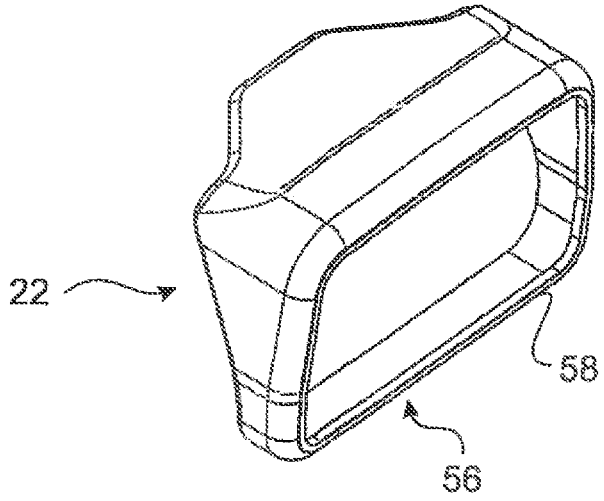
FIG. 11 shows a front panel of the belt buckle from FIG. 1.

The casing 12 in the embodiment shown here is made of plural casing parts, namely a first shell part 18 (see also FIGS. 4 and 6), an opposite second shell part 20 (also see FIG. 13) as well as a front panel 22 (illustrated in detail in FIGS. 11 and 12) axially abutting on both shell parts 18.

Figure 5:
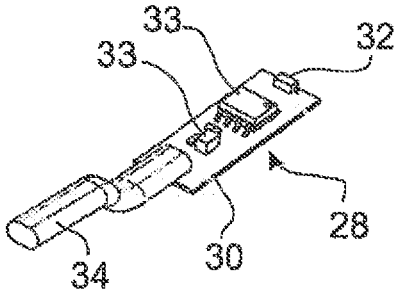
FIG. 5 shows an electronic control module of the illumination system of the belt buckle from FIG. 1.
Figure 6:
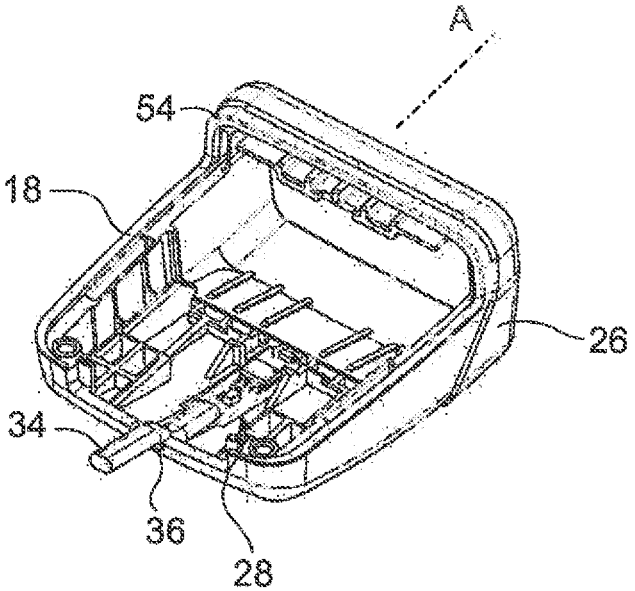
FIG. 6 shows a representation of the electronic control module mounted in the first shell part.

Moreover, the belt buckle 10 includes an illumination system 24 (see FIG. 14) comprising a light conductor 26 (see FIGS. 7 to 10 in detail) as well as an electronic control module 28 (see especially FIGS. 5 and 6).

The electronic control module 28 of the illumination system 24 includes a control board 30 on which one or more LED are provided as lamps 32 as well as corresponding electronics 33 adapted to control the lamps 32 as to luminous period, luminous intensity and, where appropriate, luminous color is provided. The lamps 32 optionally may be provided in one color only or there may be provided plural lamps 32 in different colors which are controlled by the electronics 33 so that any color is generated. The choice of color may be dependent on the situation and also changes in color are possible.

The electronic control module 28 is for example a LIN module for connection to a LIN bus in the vehicle.

An electric feed line 34 enables the electronic control module 28 to be supplied with electrical energy. The electric feed line 34 is combined, for example, with a supply line for a switch (not shown in detail) for detecting the inserted locking tongue.

The electronic control module 28 in this example is fixed to the inside of the first shell part 18, for instance by a snap or welding connection. A cable passage 36 is integrated in the inside of the first shell part 18 (see FIG. 6) and in this case also causes strain relief for the feed line 34.

The light from the lamps 32 is coupled into the light conductor 26. The light conductor 26 in this context includes an extension 38 extending in the axial direction A away from the insertion opening 14 which extension serves as coupling element and which includes at a free end a front-side coupling surface 40 into which the light irradiated from the lamps 32 enters.

At its other end the extension 38 is transformed into an annular portion 42 which in this case is peripherally closed.

In the area of the transition a recess 44 in the form of an opening in the annular portion 42 is provided, in this case in the form of a triangle, the point of which faces the coupling surface 40. The sides 46 of the recess 44 inclined relative to the axial direction A serve for reflecting the light entering the annular portion 42 through the extension 38 in the circumferential direction into the annular portion 42.

The end face 48 of the annular portion 42 of the light conductor 26 facing away from the extension 38 constitutes a light emission area 60. In this example the end face 48 has a planar design.

The end face 50 of the annular portion 42 opposed to the end face 48 exhibits a structured surface, on the other hand. In this example, a plurality of uniform structures 52 are juxtaposed, wherein in this case the structures 52 are formed by prisms each of which has a trapezoidal cross-section and the longitudinal direction of which is oriented transversely to the circumferential direction. This is indicated in FIGS. 8 and 9.

The structures 52 serve for reflecting the light in the annular portion 42 toward the front end face 48 where it is intended to leave the light conductor 26.

Figure 10:
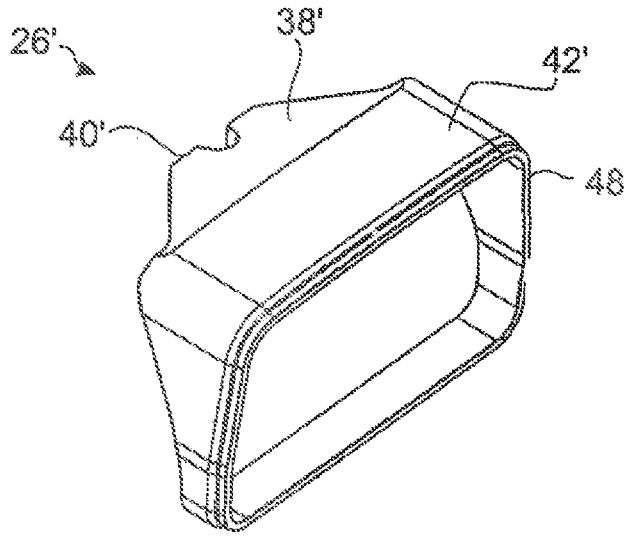
FIG. 10 is a variant of the light conductor from FIG. 7.

FIG. 10 shows a variant of a light conductor 26'. In this case the extension 38' is shorter, but the coupling surface 40' is wider so that e.g. the lamp 32 more easily may include plural juxtaposed LED. There may also be plural coupling surfaces 40' located next to each other or there may be provided a coupling surface extending in curved shape around the lamp 32. The rear end face may be structured or even also in this case.

The first shell part 18 of the casing 12 includes an annular projection 54 (see FIGS. 6 and 12) extending around the looking tongue insertion opening 14. The projection 54 is formed integrally with the residual first shell part 18. The entire first shell part 18, but especially the projection 54, is opaque in this example. The material for the first shell part 18, but also for the other parts of the casing 12, is considered to be acrylonitrile-butadiene-styrene (ABS) or polypropylene (PP), for example.

The light conductor 26, 26' consists, for instance, of polycarbonate (PC).

When mounting the belt buckle 10, the light conductor 26 is attached with its annular portion 42 onto the projection 54 at the first shell part 18 and may be connected to the projection 54 by welding (ultrasound or laser welding) or gluing, for example.

Light emission of the light conductor 26 radially inwardly is prevented by the projection 54. The projection 54 extends in the axial direction A in this example at least up to the end face 48 of the light conductor 26 or even somewhat beyond the same, as is evident from FIG. 14.

Figure 12:
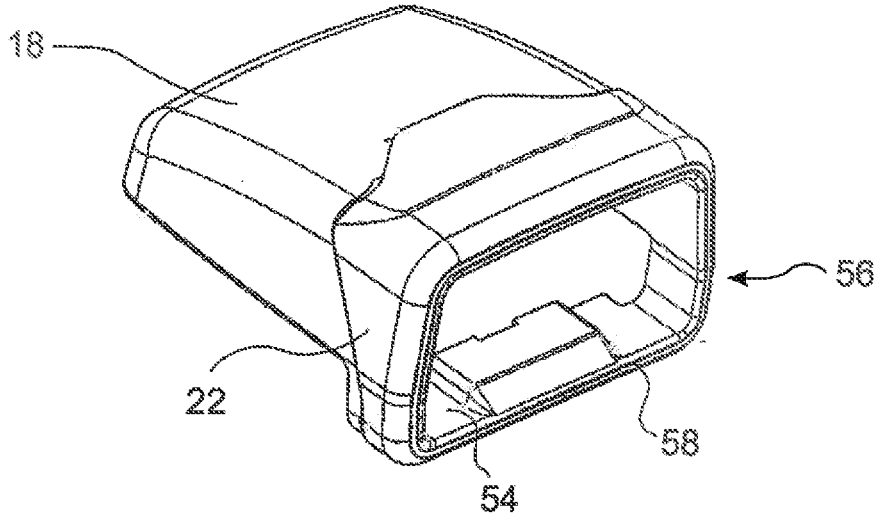
FIG. 12 shows a first shell part having a mounted light conductor and a mounted front panel for the belt buckle from FIG. 1.
Figure 13:
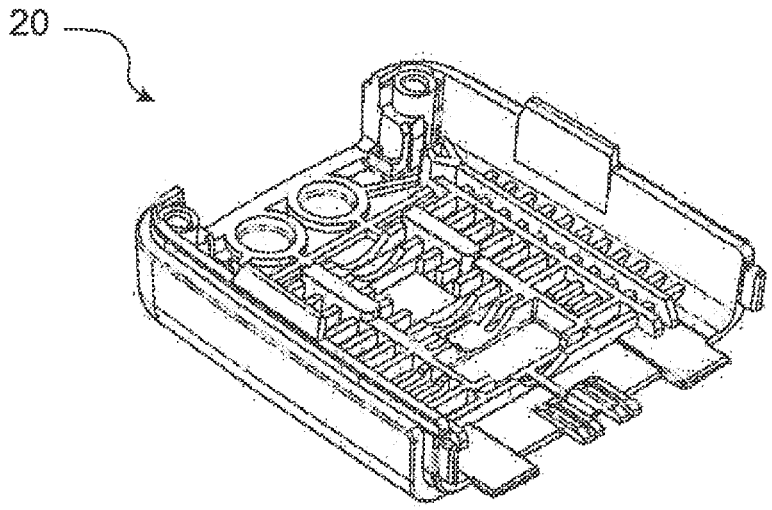
FIG. 13 shows the inside of a second shell part of the casing of the belt buckle from FIG. 1.
Figure 14:
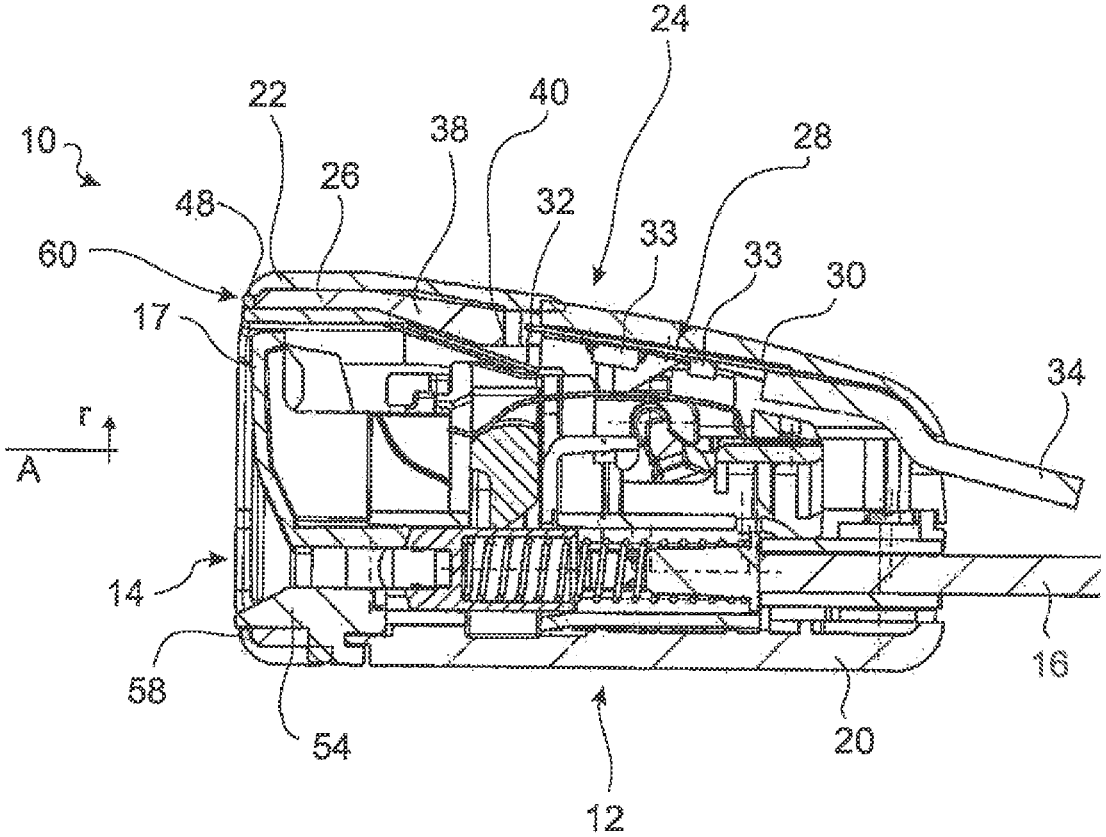
FIG. 14 shows a schematic sectional view of the belt buckle according to the invention from FIG. 1.

The front panel 22 of the casing 12 in this case is equally designed as a peripherally closed circumferential ring (see FIGS. 11 and 12) and is attached to the light conductor 26 (FIG. 12 and FIG. 14). The front panel 22 and the light conductor 26 moreover are appropriately fastened to each other, e.g. by a locking, gluing or welding connection, for example by ultrasound or laser welding, and are tightly and permanently interconnected.

The front panel 22 is opaque along its peripheral surface and thus blocks emission of light from the light conductor 26 outwardly in the radial direction r. The front panel 22 may be a design element, for example comprising a chrome-plated outer surface or having a piano lacquer appearance. The front panel 22 is manufactured separately from the other casing parts so that the appearance of the belt buckle 10 can be varied by providing a differently designed front panel 22.

On the locking tongue-side end face 56 of the front panel 22 a transparent annularly circumferential diffusor 58 surrounding the locking tongue insertion opening 14 is provided through which the light emitted from the end face 48 of the light conductor 26 penetrates to the outside. The diffusor 58 is connected in the axial direction A to the end face 48 of the light conductor 26. Between the diffusor and the end face 48 of the light conductor 26 an air gap is formed which in this embodiment has a height of 0.25 mm.

The diffusor 58 may be configured so that it influences the color of the emitted light and/or varies the emission characteristic of the end face 48 of the light conductor 26. However, it also provides for a gap-free termination of the casing 12 to the outside and prevents dirt from penetrating the casing 12. The diffusor 58 and the front panel 22 therefore are formed integrally by two-component injection-molding in this example. For example polycarbonate (PC) is used as a material for the diffusor. The looking tongue-side end face of the diffusor is structured, i.e. roughened fine-grained with low roughness, to improve the homogeneity of the light emission.

Instead of the light conductor 26, also the light conductor 26' shown in FIG. 10 can always be mounted.

As the last mounting step, the second shell part 20 is connected to the first shell part 18, for example by a snap, gluing or welding connection.

In the radial direction r the width of the end face 48 is approximately 1 mm, for example. The width of the diffusor 58 in the radial direction r is selected here in the same order of magnitude. In this way, a light emission area 60 of the belt buckle 10 is formed which is configured to be peripherally circumferential around the locking tongue insertion opening 14 and which widthwise amounts to approx. 1 mm.

The projection 54 of the first shell part 18 as well as the front panel 22 prevent light from being emitted from the light conductor 26 in the radial direction r so that light is emitted only from the light emission area 60 and the light emission area 60 forms the only illuminated portion of the belt buckle 10.

The FIGS. 15 to 28 show further embodiments.

Figure 15:
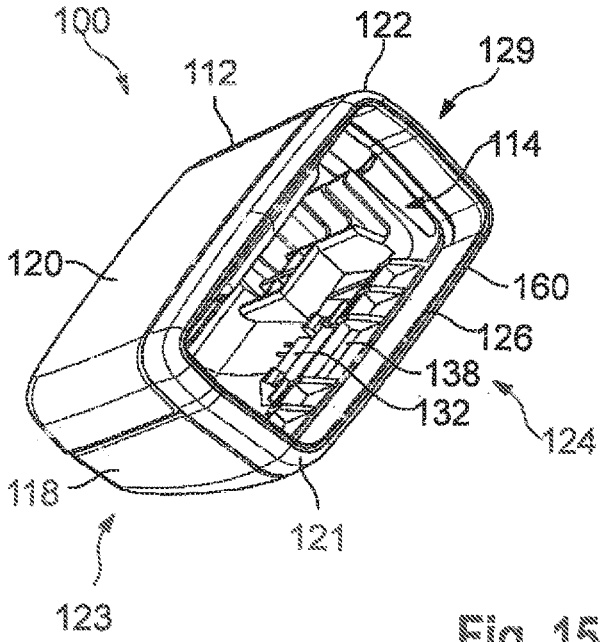
FIG. 15 is a perspective view of a belt buckle according to the invention in accordance with a further embodiment.
Figure 16:
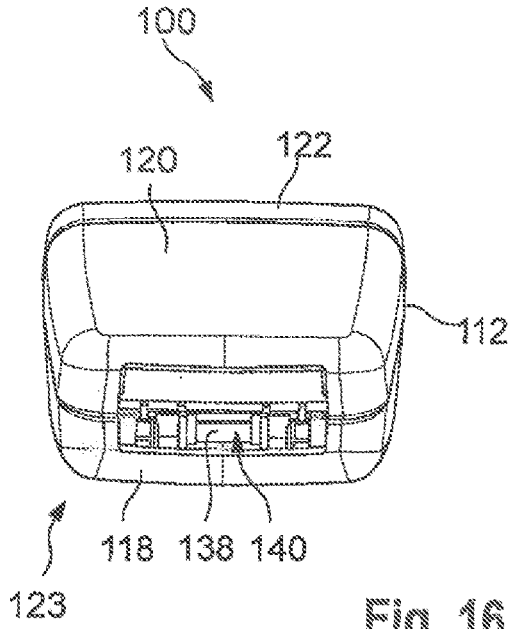
FIG. 16 is another perspective view of the belt buckle from FIG. 1.
Figure 17:
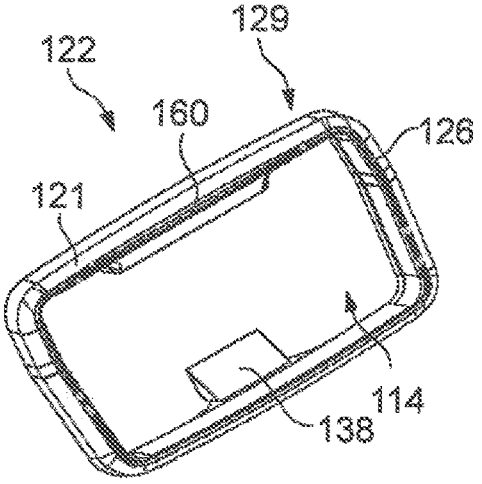
FIG. 17 is a perspective view of a casing part of the belt buckle from FIGS. 15 and 16.
Figure 18:
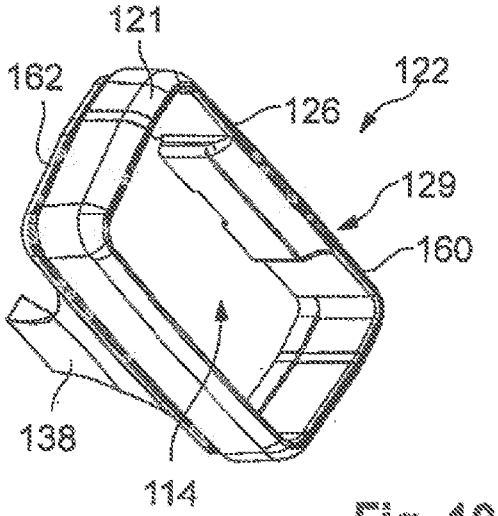
FIG. 18 is another perspective view of the casing part from FIG. 17.
Figure 19:
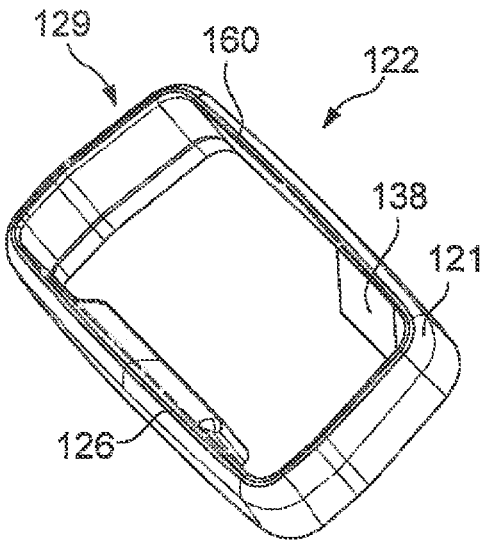
FIG. 19 is another perspective view of the casing part from FIG. 17.
Figure 20:
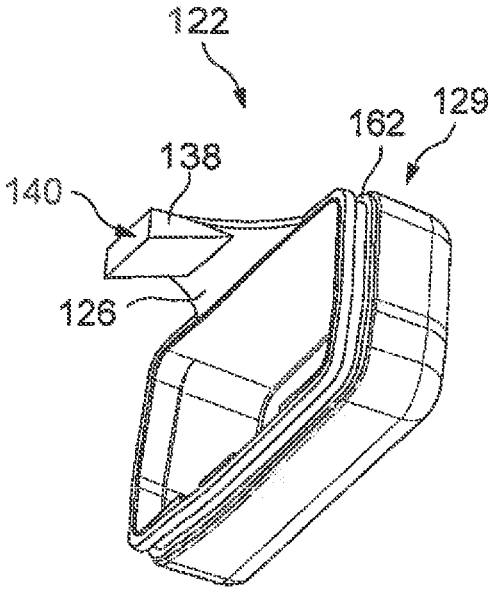
FIG. 20 is another perspective view of the casing part from FIG. 17.
Figure 21:
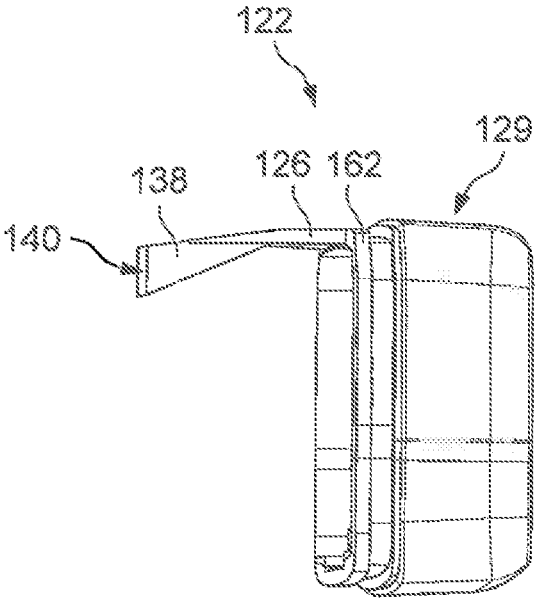
FIG. 21 is another perspective view of the casing part from FIG. 17.
Figure 22:
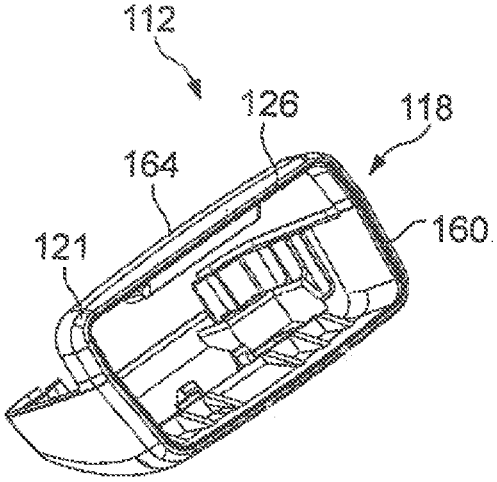
FIG. 22 is a perspective view of a casing shell of a belt buckle in accordance with another embodiment.
Figure 23:
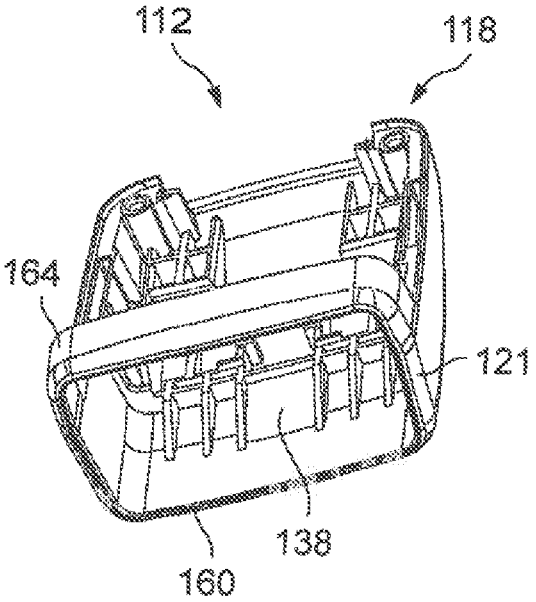
FIG. 23 is another perspective view of the casing shell from FIG. 22.
Figure 24:
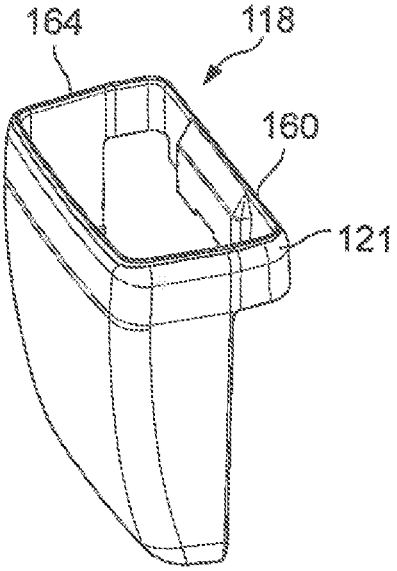
FIG. 24 is another perspective view of the casing shell from FIG. 22.

In FIGS. 15 and 16 a belt buckle 100 according to another embodiment is illustrated, wherein the closing mechanism of the belt buckle 100 interacting with a locking tongue is not shown for reasons of clarity.

The belt buckle 100 includes a belt buckle casing 112 which has a three-part design in the shown embodiment.

The casing 112 includes a first shell part 118, also considered to be a first casing shell, a second shell part 120, also referred to as second casing shell, as well as a casing part forming a front panel 122 and including an edge 121 which borders a receiving area 114 for a locking tongue including an insertion opening for the locking tongue.

The two shell parts 118, 120 together form a base body 123 of the casing 112 into which the front panel 122 is inserted. Thus the two shell parts 118, 120 and the front panel 122 are coupled to each other so as to form the complete casing 112.

Furthermore the belt buckle 100 includes an illumination system 124 comprising a lamp 132 as well as a light conductor 126. The lamp 132 may be a LED which emits, for example, red light. Alternatively, also a multi-color LED may be provided so that the color of the emitted light can be adapted to the preferences of the vehicle occupant.

The lamp 132 is provided inside the belt buckle 100, wherein it is arranged on the first shell part 118. The light conductor 126, on the other hand, is arranged in a casing portion 129 of the casing 112 which in the shown embodiment is constituted by the second shell part 120. Therefore the lamp 132 and the light conductor 126 are arranged on different parts of the three-part casing 12.

The light conductor 132 further includes a coupling element 128 which in the assembled state of the belt buckle 100 is coupled to the lamp 132 such that the light emitted from the lamp 132 is coupled into the light conductor 126 via the coupling element 138.

The coupling element 138 is tapered in wedge shape so that the coupling element 138 has a large coupling surface 140. The light coupled via the coupling element 138 extends via the light conductor 126 to an output surface 160 which is arranged at the edge 121 of the casing 112.

In the shown embodiment, the output surface 160 is formed as a circumferential ribbon at the edge 121 so that if encloses the insertion opening and the receiving area 122 in ring shape.

The output surface 160 especially has a width of 0.5 mm to 1.5 mm, preferably of 1 mm, and is arranged directly on the surface of the casing 112 located in the visual range of the belt buckle 100, when the latter adopts a typical position in a vehicle.

In FIGS. 17 to 21 the casing part corresponding to the front panel 122 of the first embodiment is separately illustrated.

It can be inferred from FIGS. 17 to 21 that, in addition to the output surface 160 and the coupling element 138, the light conductor 126 includes a connecting structure 162 via which the front panel 122 can be coupled to the two shell parts 118, 120 and, resp., to the base body 123. The connecting structure 162 is formed at an end of the front panel 122 opposed to the edge 121.

From the Figures one can further take that the light conductor 126 is embedded in the front panel 122, as the light conductor 126 is substantially surrounded by the casing material of the front panel 122. Merely the output surface 160 at the edge 121 as well as the coupling element 138 and the connecting structure 162 are not surrounded by the casing material. The light conducting structure of the light conductor 126 thus extends substantially inside the front panel 122 so that only the output surface 160, the coupling element 138 and the connecting structure 162 of the light conductor 162 are visible.

Accordingly, the light conductor 126 is formed integrally with the casing portion 129 and the front panel 122, respectively, in the shown embodiment.

The front panel 122 therefore may preferably be manufactured by multi-component injection-molding. In this way, the inner and outer casing surfaces of the front panel 122 are ensured to be formed of a first opaque material, whereas the light conductor 126 embedded therein is made from a second light-conductive material. Thus the light conductor 126 is surrounded by the casing material of the front panel 122 or the front panel 122, resp., and includes merely one single output surface 160.

The material for the light conductor 126 may be, for instance, high-tech refined plastics exhibiting special light scattering, light conducting properties or an additional metallic effect.

On the other hand, the first and second shell parts 118, 120 in this embodiment may have been manufactured by single-component injection-molding, as these parts may be standardized components.

As an alternative, the light conductor 126 may also be a separate component and may be engaged in the casing portion 129 and, resp., in the front panel 122. For this purpose, both the light conductor 126 and the casing portion 129 and, resp., the front panel 122 may exhibit an engaging structure.

FIGS. 22 to 28 illustrate the first shell part 118 of a belt buckle 100 according to a further embodiment which is merely designed in two parts. Like or equally acting components therefore are provided with the reference numerals already introduced before.

In this embodiment the casing 112 represented only partly is thus formed by the two shell parts 118, 120 only the first shell part 118 of which is shown.

The first shell part 118 includes a casing portion 164 substantially corresponding to the front panel 122 in the first embodiment according to FIGS. 15 to 21. Analogously to the front panel 122 of the first embodiment, the casing portion 164 includes the peripheral edge 121 and the light conductor 126 which in the previous embodiment is embedded in the first shell part 118. The output surface 160 of the light conductor 126 is provided, analogously to the first embodiment, on the edge 121 which now is arranged on the first shell part 118.

According to the previous embodiment, the first shell part 118 thus includes, as compared to the first shell part 118 according to this embodiment, additionally the front panel 122 which in this embodiment is formed integrally with the first shell part 118 and is referred to as the casing portion 162.

Figure 25:
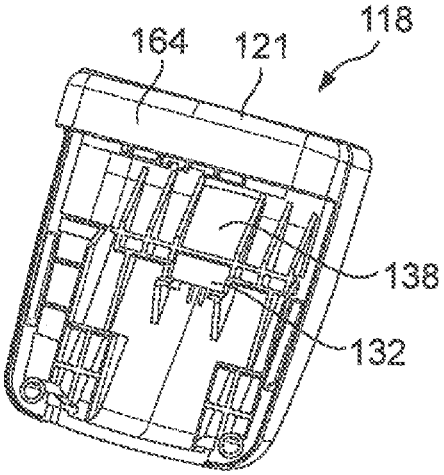
FIG. 25 is another perspective view of the casing shell from FIG. 22.
Figure 26:
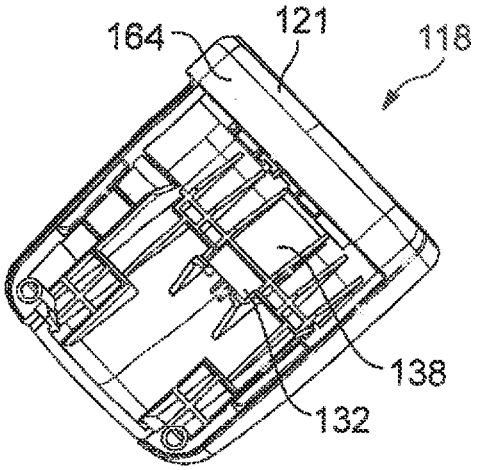
FIG. 26 is another perspective view of the casing shell from FIG. 22.
Figure 27:
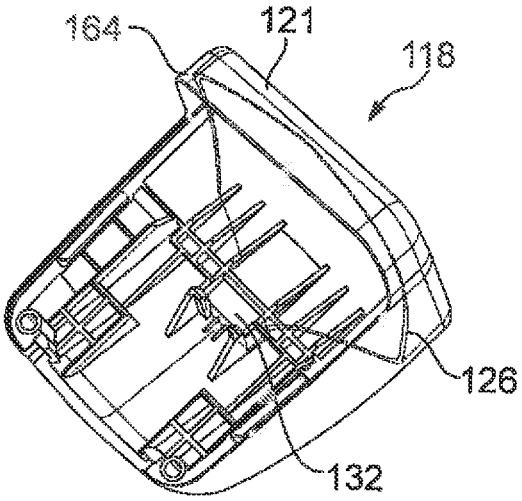
FIG. 27 shows a semi-transparent perspective representation of the casing shell of FIGS. 22 to 26.
Figure 28:
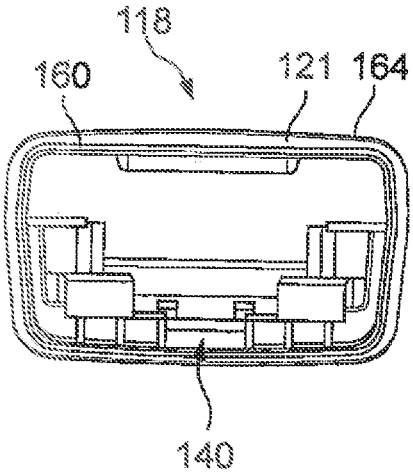
FIG. 28 shows a top view onto the casing shell of the FIGS. 22 to 27.

In this embodiment, the lamp 132 shown in the FIGS. 25 to 27 is equally arranged on the inner surface of the first shell part 118. Hence in this embodiment both the lamp 132 and the light conductor 126 are provided on the same casing portion or, resp., part of the casing 12. This also applies to the coupling element 128 which interacts with the lamp 132 via its coupling surface 140.

Since the first shell part 118 includes the light conductor 126, it was preferably manufactured by multi-component injection-molding. The light conductor 126 therefore is surrounded substantially completely by the casing material of the first shell part 118 or, resp., is substantially embedded in the first shell part 118.

The second shell part 120 in this embodiment, which is not shown in the Figures, may be designed analogously to the second shell part 120 according to the previous embodiment and may have been manufactured by single-component injection-molding, as it may be a standardized component.

In the two-part embodiment according to FIGS. 22 to 28, the second shell part 120 is attached or slipped on and is fixed by the first shell part 118 so that the complete belt buckle casing 112 is configured.

In general, in both embodiments of the belt buckle 100 the parts forming the casing 112, viz. the two shell parts 118, 120 and possibly the front panel 122, are provided to be attached or slipped onto each other or inserted so as to provide a casing 112 which can be easily released. In this way the lamp 26 can be quickly and easily replaced, if required.

In general prior to assembling the belt buckle 100 the components for the belt buckle mechanism interacting with the locking tongue are inserted in the first shell part 118.

Generally, it is ensured by the geometry of the light conductor 126 and the optional use of lenses that the output surface 160 is homogenously illuminated so that a uniformly peripheral light band marks the receiving area 114 so that the later can be easily found by the vehicle occupant.

Furthermore, generally a chrome element may be provided at the edge 121 so as to impart an appearance of higher quality to the belt buckle casing 112. The chrome element may be in the form of a peripheral chrome ring and may especially be arranged adjacent to the output surface 160 so that the output light is reflected by the chrome surface. Preferably the chrome element is provided next to the output surface 160 on the side of the output surface 160 facing away from the insertion opening 114.

The lamp 132 may in general be a kind of pre-assembled unit, that is to say that electric connections as well as optionally a series resistor are provided which merely have to be connected when mounting the belt buckle 100.

The invention claimed is:

1. A belt buckle comprising a casing (12) and an illumination system (24) present in an area of a locking tongue insertion opening (14), wherein the illumination system (24) comprises a lamp (32) and a light conductor (26; 26') having a light emission area and the light conductor (26; 26') includes an annular portion (42; 42') which surrounds at least a major part of the locking tongue insertion opening (14), the light emission area being formed to be peripherally circumferential on an axial end face (48; 48') of the annular portion (42; 42') of the light conductor (26; 26'), wherein the annular portion (42; 42') of the light conductor (26; 26') is arranged radially inside a front panel (22) of the casing (12) which is at least largely peripherally closed, with the front panel (22) framing the insertion opening (14), and in that the front panel (22) includes an annular at least partly transparent diffusor (58) which is axially adjacent to the light emission area of the light conductor (26; 26') such that light emitted by the lamp (32) passes through the diffusor (58) after passing through the light conductor (26; 26').

2. The belt buckle according to claim 1, wherein, with an exception of the diffusor (58), the front panel (22) is opaque.

3. The belt buckle according to claim 1, wherein an air gap is formed between the diffusor (58) and the light emission area of the light conductor (26; 26').

4. The belt buckle according to claim 1, wherein the casing (12) includes a first shell part (18) having an annularly circumferential projection (54) which is arranged radially inwardly of the light conductor (26; 26').

5. The belt buckle according to claim 4, wherein the casing (12) consists of the first shell part (18), the front panel (22) and a second shell part (20).

6. The belt buckle according to claim 1, wherein the illumination system (24) comprises an electronic control module (28) in which the lamp (32) as well as electronics (33) are disposed, and especially wherein the electronic control module (28) is mounted on an inside of a first shell part (18) of the casing (12).

7. The belt buckle (100) according to claim 1, wherein the light conductor (126) is connected to, especially engaged in or permanently arranged on the casing of the belt buckle.

8. The belt buckle (100) according to claim 1, wherein the light conductor (126) includes a coupling element (138) which is coupled to the lamp (32) and is especially designed to be tapered in wedge shape.

9. The belt buckle (100) according to claim 1, wherein the casing (112) of the belt buckle is a multi-part casing, wherein the light emission area of the light conductor (126) is provided on an edge (121) of the casing of the belt buckle and is associated with a casing portion (129, 164) on which the edge (121) is formed.

10. The belt buckle (100) according to claim 9, wherein the light conductor (126) is substantially embedded in the casing portion (129, 164).

11. The belt buckle (100) according to claim 9, wherein the casing of the belt buckle is a two-part casing and comprises first and second shell parts (118, 120), the casing portion (164) being provided at the first shell part (118).

12. The belt buckle (100) according to claim 11, wherein the light conductor (126) includes a connecting structure (162) by which the front panel (122) is connectable to the shell parts (118, 120).

13. The belt buckle (100) according to claim 9, wherein the casing of the belt buckle is a three-part casing and comprises two shell parts (118, 120) as well as an, especially insertable, front panel (122) on which the casing portion (129) is provided.

14. The belt buckle according to claim 1, wherein the light conductor is positioned within the casing and the diffusor covers the light emission area of the light conductor.

15. A belt buckle comprising a casing (12) and an illumination system (24) present in an area of a locking tongue insertion opening (14), wherein the illumination system (24) comprises a lamp (32) and a light conductor (26; 26') having a light emission area and an annular portion (42; 42') which surrounds at least a major part of the locking tongue insertion opening (14), the light conductor (26) further comprising a structured surface including a plurality of juxtaposed structures (52) on an end face (50) facing away from the light emission area, wherein the annular portion (42; 42') of the light conductor (26; 26') is arranged radially inside a front panel (22) of the casing (12) which is at least largely peripherally closed, with the front panel (22) framing the insertion opening (14), and in that the front panel (22) includes an annular at least partly transparent diffusor (58) which is axially adjacent to the light emission area of the light conductor (26; 26').

16. The belt buckle according to claim 15, wherein the juxtaposed structures (52) are prisms.

17. A belt buckle comprising a casing (12) and an illumination system (24) present in an area of a locking tongue insertion opening (14), wherein the illumination system (24) comprises a lamp (32) and a light conductor (26; 26') having a light emission area and an annular portion (42; 42') which surrounds at least a major part of the locking tongue insertion opening (14), wherein an extension (38; 38') projects axially from the annular portion (42; 42') of the light conductor (26; 26') and through which light of the lamp (32) is coupled into the light conductor (26; 26'), wherein a recess (44) is provided in an area of a transition of the extension (38) into the annular portion (42) and shaped so that a coupled light is distributed uniformly in the annular portion (42), wherein the annular portion (42; 42') of the light conductor (26; 26') is arranged radially inside a front panel (22) of the casing (12) which is at least largely peripherally closed, with the front panel (22) framing the insertion opening (14), and in that the front panel (22) includes an annular at least partly transparent diffusor (58) which is axially adjacent to the light emission area of the light conductor (26; 26').

* * * * *